United States Patent [19]

Smith

[11] 4,436,077

[45] Mar. 13, 1984

[54] GUN AND RESILIENT LOOP PROJECTILE THEREFOR

[76] Inventor: Wayne G. Smith, 10129, Overland Park, Kans. 66212

[21] Appl. No.: 330,073

[22] Filed: Dec. 14, 1981

[51] Int. Cl.[3] ..... F41B 7/00

[52] U.S. Cl. ..... 124/18; 273/317; 273/DIG. 8; 273/DIG. 24; 124/35 R; 124/83; 124/1; 124/45

[58] Field of Search ..... 124/18, 19, 35 R, 41 R; 273/424, 425, DIG. 8, DIG. 10, DIG. 24, 332; 272/137, 142

[56] References Cited

U.S. PATENT DOCUMENTS

| | | | |
|---|---|---|---|
| 1,729,738 | 10/1929 | Dudas et al. | 124/18 |
| 1,868,312 | 7/1932 | Coventry | 124/18 |
| 3,951,404 | 4/1976 | Brown | 272/142 |

*Primary Examiner*—Richard J. Apley
*Assistant Examiner*—William R. Browne
*Attorney, Agent, or Firm*—Kokjer, Kircher, Bradley, Wharton, Bowman & Johnson

[57] ABSTRACT

A gun for firing a resilient loop projectile, wherein the missile is stretched over a frame and discharged by a firing mechanism movable against the bias of on elastic member on an upwardly and rearwardly directed rectilinear path of travel. A combination plunger and rear sight has a forwardly curved surface to lift the loop upwardly off the firing groove to discharge the missile from the gun. The contour of the gun permits rapid movement of a missile from a ready position to a firing position and admits of the simultaneous loading with two missiles for rapid fire. The gun is constructed in a manner to resemble the feel and firing characteristics of a conventional hand gun. The projectiles for the gun are fabricated from a length of elastic tubing having a flexible polyurethane rod joining the tube ends to close the loop and enhance the firing accuracy and durability of the missile. The projectile is made of high visibility material and is floatable to insure recoverability after firing.

14 Claims, 11 Drawing Figures

GUN AND RESILIENT LOOP PROJECTILE THEREFOR

This invention relates to a shooting apparatus and more particularly to a gun and resilient or elastic loop missile to be projected from the gun.

Many persons enjoy shooting but desire to avoid the danger, expense and regulation associated with shooting with conventional firearms. Various alternatives such as archery and sling-shot devices are available, but these have a number of drawbacks, not the least of which is the substantial dissimilarity with firearm shooting, particularly concerning the feel, sighting and triggering of the devices. Despite the widespread popularity which such devices have commanded, there remains a need for an alternative to firearm shooting which preserves many of the similarities with such shooting without the attendant disadvantages ordinarily associated therewith.

A variety of shooting devices have heretofore been suggested for propelling elastic band missiles. While such apparatuses have enjoyed some measure of limited popularity, they have, in the main, been rather crude devices, poorly thought out, and useful primarily as toys.

Accordingly, it is a primary object of this invention to present a new and novel gun and resilient loop missile to be projected thereby which may be utilized to produce most of the enjoyment attainable from handgun firearm shooting, yet which avoids substantially all of the disadvantages attendant upon the use firearms.

Another equally important aim of the present invention is to provide a gun and missile therefor which is constructed in a manner to preserve much of the feel and sensation of firearm shooting, yet which avoids the danger and expense thereof.

Still a further object of the invention is to present a device of this type which is "fired" with substantially the same movements as are involved in the shooting of conventional firearms.

A further object of the invention is to provide a novel band type missile which has sufficient power to produce demonstrated force at the point of impact, including destructive force on relatively fragile objects, yet which is relatively safe from damaging more substantial objects.

Still another important object of the present invention is to provide a missile constructed in a manner to enhance the rapid, repetitive loading of the gun, the centering of the missile to produce a great degree of accuracy, and to insure against deleterous wear on the missile at the critical zone of contact with the gun during the loading and "firing" process.

Yet another important object of the present invention is to provide a highly durable missile which may be used over and over again and which is not readily subject to inadvertent loss during the process.

These and other important aims and objectives of the present invention will be further explained or will be apparent from the description and explanation of the drawings, in which.

Figure 4:
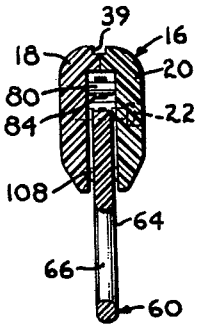
FIG. 4 is a cross-sectional view taken along line 4—4 of FIG. 1.

A gun for projecting resilient loop missiles is broadly designated in the drawings by the reference numeral 10 and includes a handle 12 and an elongated frame 14 configured to resemble a gun barrel. Handle 12 is integral with frame 14 to conjointly define a body 16 preferably formed from two vertically separated body portions 18 and 20. As appears best in FIGS. 1, 2 and 4, body portions 18 and 20 are secured together with a plurality of transversely extending screws 22 so that the entire body resembles the shape of a handgun. Body portions 18 and 20 are each formed in one piece and each is shaped so that handle 12 projects rearwardly and downwardly from frame 14 intermediate the extreme ends of the latter with a substantial section 24 of frame 14 projecting to the rear of the handle.

Figure 2:
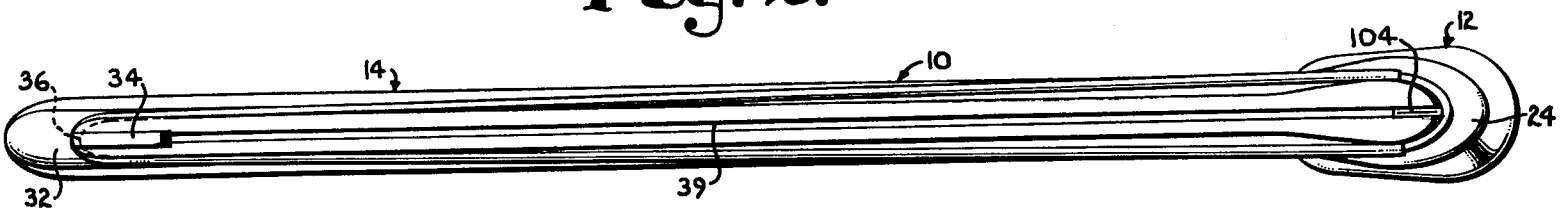
FIG. 2 is a top plan view of the gun and missile of FIG. 1.
Figure 3:
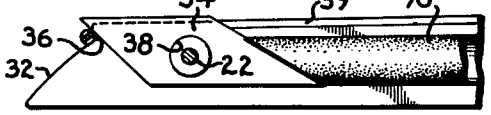
FIG. 3 is an enlarged, fragmentary side elevational view of the forward end of the gun "barrel" or frame, parts being broken away and appearing in cross-section to reveal details of construction.

Referring particularly to FIG. 2, it may be seen that gun 10 is contoured so that the upper longitudinal surface of the gun is sloped inwardly toward the longitudinal axis and section 24 slopes forwardly and inwardly to a reduced cross-sectional dimension as the uppermost portion of the body is approached. The shape at the extreme rearmost end of section 24 is configured to present a first rearwardly facing groove 26 and a second similarly facing groove 28, the two grooves are separated vertically by a ridge 30 for a purpose to be described hereinafter. The forwardmost end of frame 14 has an upwardly and rearwardly curved surface 32 which cooperates with an angularly shaped member 34 interposed between the body portions 18 and 22 to define a notch 36 between surface 32 and the forward face of member 34 as shown best in FIG. 3. A hole 38 extends transversely through member 34 and is adapted to receive the proximal transverse screw 22 for securing member 34 in the position illustrated. In this position, member 34 provides a front sight for gun 10 and also defines the front groove or notch 36.

Each of the body sections 18 and 20 are configured at their respective upper surfaces to define a sighting channel 39 extending longitudinally of frame 14. The upper portion of member 34 is readily visible when sighting along channel 39 from the rear of the gun.

Figure 1:
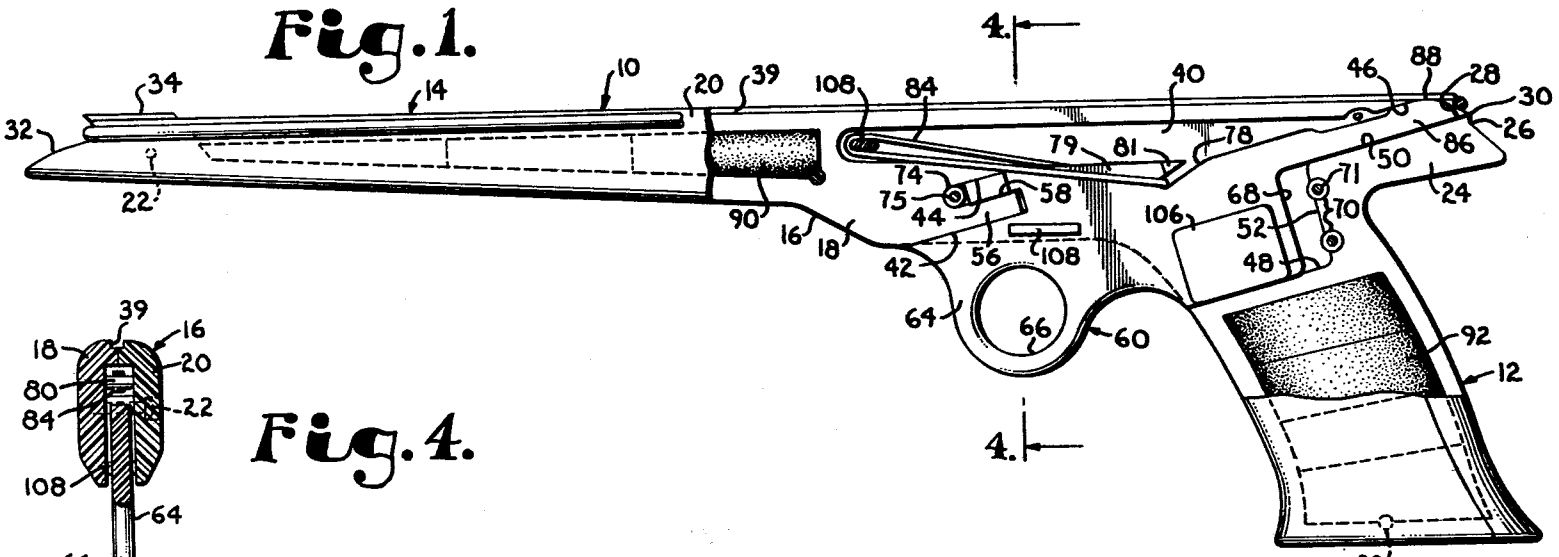
FIG. 1 is a side elevational view of a gun constructed pursuant to the principles of this invention, showing a missile of the invention in its firing position, parts being broken away to reveal details of construction, and certain parts appearing in phanton.
Figures 6, 7, 8, 9, 10, 11:
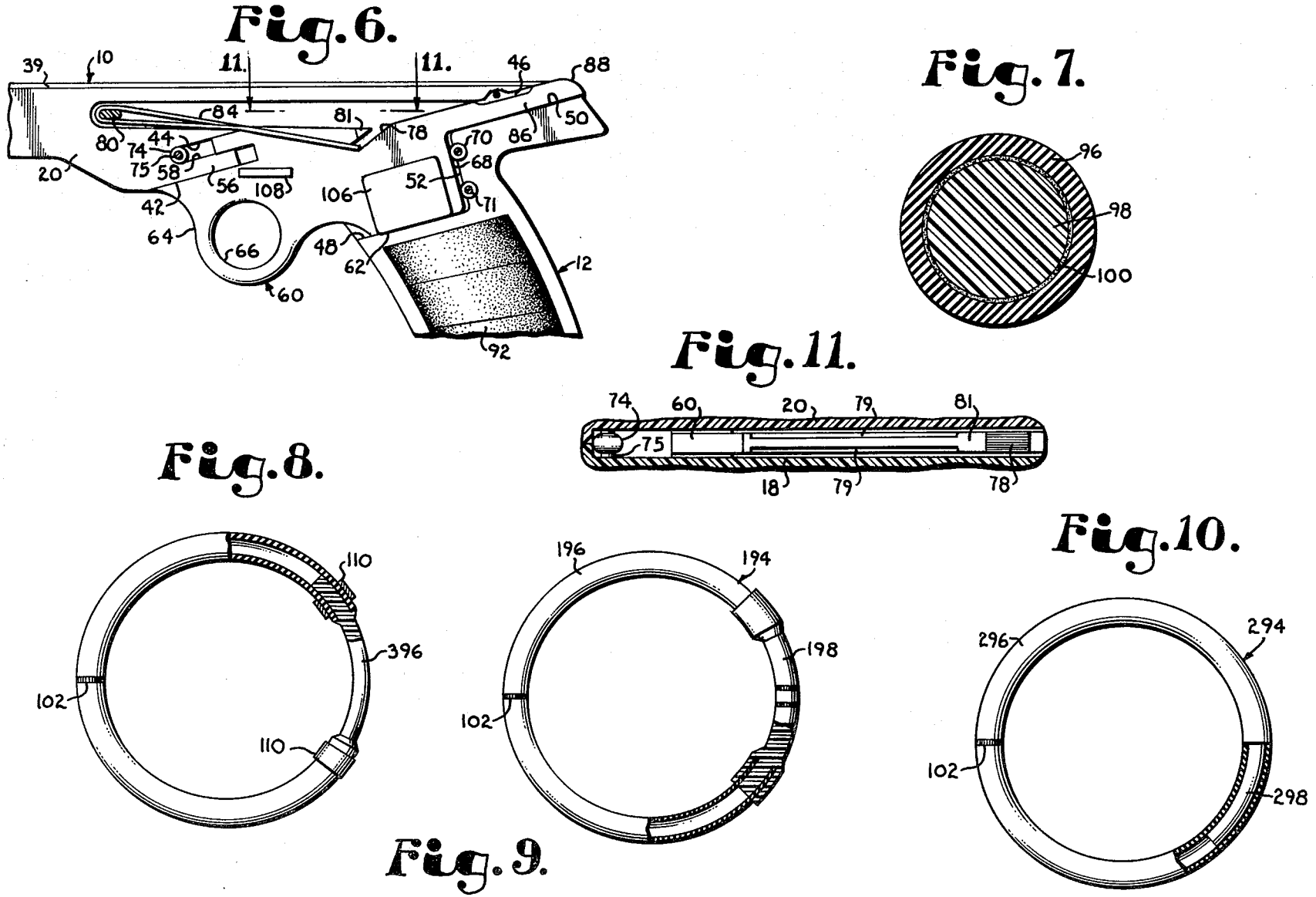
FIG. 6 is a fragmentary view similar to FIG. 1, but showing the actuating member of the gun in its extreme rearmost position.
FIG. 7 is a greatly enlarged cross-sectional view taken along line 7—7 of FIG. 5.
FIG. 8 is an enlarged, top plan view similar to FIG. 5, but illustrating a slightly modified construction.
FIG. 9 is a view similar to FIG. 8 but illustrates another modified construction.
FIG. 10 is a view similar to FIGS. 8 and 9 but illustrating a still further modified construction.
FIG. 11 is an enlarged detailed, fragmentary cross-sectional view taken along line 11—11 of FIG. 6, the elastic band having been removed for clarity.

The body sections 18 and 20 are each cut away to present a generally upwardly and rearwardly directed cavity 40 opening in front of the handle and at the rear of the rearwardly projecting section 24. Cavity 40 is partially defined by a plurality of upper, downwardly faced parallel surfaces 42, 44 and 46. The bottom of cavity 40 is defined by a pair of vertically offset surfaces 48 and 50 which are parallel to the surfaces 42, 44 and 46 as shown in FIGS. 1 and 6 of the drawings. Surfaces 48 and 50 are interconnected by a generally upright surface 52 toward the rear of the cavity. A projection 56 extends upwardly and rearwardly into the cavity from the front of the latter. Surface 42 defines the lower face of projection 56 while the upper face 58 of the latter extends in parallelism with surfaces 42 and 44, respectively.

An elongated, irregularly shaped member broadly designated by the numeral 60 is slidably received within the cavity 40 as shown in FIGS. 1 and 6. Member 60 is configured to present a plurality of shoulders 62, each shoulder being in sliding, abutting relationship with a corresponding one of the cavity defining surfaces to confine the sliding movement of member 60 to back and forth rectilinear motion as a shoulder 62 slides along the corresponding cavity surface. Member 60 includes a trigger section 64 projecting forwardly of handle 12 through the front opening of the body cavity. Trigger 64 has a transversely extending opening 66 of a size to admit the trigger finger of the user of the gun.

The rear portion of member 60 has a rearwardly facing surface 68 parallel to surface 52 and adapted to engage a pair of tubular, resilient rings 70 telescoped over pins 71 projecting laterally from body portion 20, when member 60 is moved to its rearwardmost position. The rings 70 define a stop for member 60 and are disposed to cushion the impact at the extreme rearwardmost end of the path of travel of member 60. A projection 72 of member 60 extends forwardly above projection 56 and is adapted to engage a similar ring 74 on a pin 75 at the forwardmost end of the path of travel of member 60.

The uppermost edge of member 60 has a downwardly and forwardly extending notch 78. The uppermost region of member 60 forwardly of notch 78 is of reduced thickness to present a recess 79 on each side of the region as shown in FIGS. 1 and 11. The rear tip 81 of the member above notch 78 is, however, of full width to define a retainer projecting laterally substantially across the width of the cavity. An oval shaped pin 80 projects laterally from body portion 20 partially across cavity 40 at a location spaced forwardly of the gun from tip 81 so that a resilient member in the nature of an elastic band 84 may be looped around pin 80 and tip 81 as shown in FIG. 1 and FIG. 6 for yieldably biasing member 60 to the forwardmost end of its rectilinear path of travel. The recesses 79 allow the band to work freely without binding and the full width of tip 81 retains the band from accidental disengagement.

An elongated plunger 86 projects rearwardly from member 60 and terminates in an elongated upwardly and forwardly curved arcuate surface 88 which is visible through the rear opening of cavity 40 at all times. Surface 88 is in direct alignment with groove 28 to dislodge a projectile positioned in the groove when the trigger is pulled.

It is contemplated that the body portions 18 and 20, as well as member 60 may be formed by injection molding or the like from suitable plastic material. The weight of the gun likely will need enhancement to give it the proper feel and balance to simulate a more conventional handgun. Accordingly, it has been found desirable to include a lead slug 92 for the handle section of each body portion glued in the general position illustrated in FIG. 1. Additional lead slugs 90 in the barrel section of the gun extend rearwardly from sight member 34. These lead slugs enhance the balance, weight and feel of the gun. The precise weight added to the gun for this purpose may be custom adjusted to suit the requirements of an individual shooter by providing the slugs in discrete increments, as shown in the drawings. Portions of the slugs may be removed or added as required.

Figure 5:
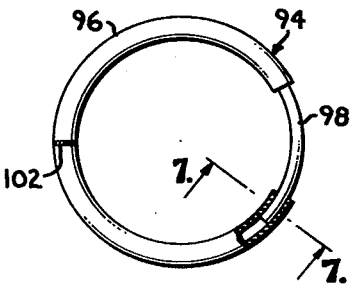
FIG. 5 is a top plan view of a missile constructed pursuant to the principles of this invention, parts being broken away and appearing in cross-section to reveal details of construction.

The missile intended for use with the gun is a closed loop projectile, such as projectile 94 illustrated in FIG. 5. Projectile 94 includes an elongated transversely circular tubular member 96 of rubber or other suitable resilient or elastic material. In the embodiment illustrated in FIG. 5, the ends of the elongated body are spaced apart and the gap between the ends is bridged by an elongated transversely circular flexible rod 98. Each end of the rod 98 is telescoped into one of the ends of body 96 and is cemented by a layer of adhesive so that the composite missile takes the shape of a generally circular loop. Rod 98 is preferably of transparent polyurethane material and is intentionally of smaller cross sectional diameter than tube 96. It has been found that if tube 96 is made of natural latex material, a layer 100 of cyanoacrylate adhesive will satisfactorily bond the polyurethane rod to the tube if the rod has first been primed with a polyurethane adhesive.

It is preferable that the tubing material 96 be of a high visibility or fluorescent color to aid in locating the projectile after it is fired from the gun. Any of a number of fluorescent colors may be utilized for this purpose including fluorescent or blaze orange or red as well as fluorescent green, fluorescent charteuse and fluorescent blue. It is also within the contemplation of this invention that, if desired, the projectile 94 may be made of phosphorescent materials so that it would glow in the dark or in darkened locations. Obviously, the phosphorescent materials may be incorporated directly in the tube material. In the alternative, the tube material may be left transparent or transluscent with a quantity of phosphorescent chemicals incorporated into the hollow channel of the tube to produce a phosphorescent glow through the tube walls.

Primarily because of the closed tubular construction of the projectile, the trapped air space results in a specific weight for the projectile of less than one so that the projectile will float in water. The floating characteristic serves to prevent inadvertent loss of the missiles in bodies of water.

All of the projectiles illustrated have an indicia mark 102 in the form of an encircling band located precisely midway from the ends of the tube. This mark serves for centering the projectile on the gun during loading as will be hereinafter more fully described. The missile 194 shown in FIG. 9 is similar to missile 94 with the exception that rod 198 is configured to present a pair of sockets for receiving the ends of tube 196. While the form of the invention illustrated in FIG. 9 is slightly more complicated and therefore more difficult and expensive to manufacture than the other missiles illustrated, the recessed ends of the polyurethane rod can be quite firmly secured to the ends of tube 196 with this construction because of the greater surface area subjected to adhesive bonding. The two layers of adhesive possible with this construction, as contrasted with the single layer in the FIGS. 5, 7 and 8 embodiments, strengthens the junction between the rod and tube.

A missile 294 illustrated in FIG. 10 is similar in all respects to the other missiles illustrated with the exception that the tube 296 completely encloses rod 298. In this case, rod 298 serves merely as a reinforcement to the tube at the critical point of its position on the gun where it will be engaged by the firing mechanism during discharge. A substantially greater amount of the surface of each tube end overlaps the ends of rod 298 so that a large surface area is subject to being bonded to the rod. It should be pointed out at this juncture that the form of construction illustrated in FIGS. 5, 7 and 8 is normally preferred because of the desirability of the reduced cross-section of the missle at the region of the rod. The FIG. 8 embodiment is similar to that of FIG. 5, but rod 396 is of even more greatly reduced cross-section dimension. The reduced cross-section of the missles at the location of the rods aids in loading and contributes to a smooth release of the missile when fired. Under ordinary conditions, it will be possible to develop sufficient force with the construction of the missiles shown in FIGS. 5, 7 and 8 without adversely affecting the bond between the polyurethane rod and the rubber tube. On the other hand, the constructions illustrated in FIGS. 9 and 10 may be resorted to when it is required to develop such great force in the missile that the force would tend to overcome the bond between the rod and the tube ends.

In use, a missile, such as that shown in FIG. 5, is loaded onto the gun by placing the centering mark 102 in notch 36 at the muzzle of the gun. The loop is then carefully pulled to the back, stretching the material of the tube 96 until the rod portion is inserted in either groove 26 or groove 28 at the back of the gun. If it is desired to carry the loaded gun in a safe condition, the back of the loop should be engaged in the lowermost groove 26. This groove is below the path of travel of plunger 86 when the trigger is pulled and will not be discharged thereby. In fact, when the trigger is pulled to the rear into the position shown in FIG. 6, the plunger extends to the rear of the frame further insuring that the rod portion in groove 26 could not slide upwardly and forwardly to discharge the loop from the gun.

It is possible and frequently desirable to carry the gun loaded with two missiles simultaneously. Obviously, it is possible to have the gun loaded with a single missile either in the standby groove 26 or, as will be subsequently described, in groove 28 ready for firing. When the gun is loaded with two missiles, a second missile is placed on the gun over the first missile except that the rod portion of the missile is hooked into upper groove 28.

With a missile in the firing position as shown in FIGS. 1 and 2 of the drawing, the user aligns the rear sight (in the form of a brightly colored line 104 painted or otherwise imparted to arcuate surface 88) along channel 39 with the front sight in the form of the upwardly projecting portion of member 34 to align the sights with the target. The transparent polyurethane rod acts as a magnifier of line 104, greatly aiding in the sighting of the pistol. When the correct sight picture is obtained, the trigger is squeezed in conventional fashion to force the member 60 upwardly and to the rear on its rectilinear path of travel against the bias of band 84. Such movement to the rear brings the curvilinear surface 88 of plunger 86 into engagement with the polyurethane rod portion of missile 94. Continued rearward movement of the member causes surface 88 to engage and dislodge the rod from groove 28. This releases the loop from the rear of the gun whereupon the release of the energy in the stretched rubber tube discharges the missile with considerable force from the gun. Obviously, friction against rod 98 occurs from the rearward movement of plunger 86 and perhaps also from drag at great speed on the upper surface of the gun. The rear surface of front sight member 34 is sloped so that the sight presents no substantial obstacle to passage of the loop forwardly of the gun. However, because of the great durability of the flexible polyurethane rod, and the antifriction characteristic of such material, the missile projects forwardly in a substantially straight path greatly enhancing the accuracy of the gun.

It has been found desirable to minimize the friction of the movement of member 60 to afford a smooth and even trigger pull. To this end, antifriction material such as tetrafluoroethylene material may be applied to the outer surface of the member to reduce the sliding friction of the member against the inner walls of cavity 40 in the body of the gun. It has been found that small strips of tetrafluoroethylene tape such as stripes 106 and 108 at strategic locations on the sliding mechanisms serve admirably for this purpose.

After the first missile has been discharged, and presuming that a second missile has been loaded onto the gun with its rod 98 positioned in groove 26, the second missile can be moved into firing position with substantially no time delay. All that is necessary is for the user to roll rod 98 with his thumb in an upward movement at the point where the tube has been bonded to its rod. This function may be accomplished on either side of the pistol so that neither right nor left handed shooters will be inconvenienced. The forward and inward tapering configuration of the gun at the region where the tube is rolled upwardly, in combination with the stretch in the missile tube, snaps the rod into groove 28 where it is in position to be discharged from the missile in this same manner as has heretofore been described.

The utilization of elastic tubing for the construction of the missiles permits the storage of a surprising amount of potential energy in the projectile when it is in its stretched condition on the gun frame. The rearward projecting portion 24 of the frame allows for a substantial stretch without entailing enough forward extension from the handle to make the gun unwieldly and difficult to handle. The force stored in the missile in its stretched condition is instantaneously released in a smooth, gliding manner by the upward and rearward lifting movement of the firing plunger surface. Such movement insures the smooth transition of the missile from its ready position to its fired condition so that the accuracy of the flight of the projectile is insured.

The large size and resilient nature of the projectile is multi-purpose. The large size and soft, resilient material of the projectile precludes its penetration through substantial objects. The lack of penetration results in the total energy transfer from the projectile to the target. Such transfer produces dramatic effects on light weight objects. At the same time, the soft, resilient material and lack of penetration preclude the projectile from damaging substantial objects such as walls, woodwork, or windows.

The projectile does produce enough energy to dent or destroy lightweight insubstantial objects such as aluminum cans, paper or plastic cups. The projectiles may also be used for destroying insects of other pests.

The large size of the projectile means that the shooter has more leeway in error and still can hit the intended target. This of course is more rewarding and satisfying for the shooter.

The gun is similar enough in its operational nature to make it a very useful learning tool for the instructor in handgun shooting. The gun has the advantages of being used just about anywhere without the usual noise, expense, recoil and lethal potential of a conventional handgun. The gun does possess sufficient power that eye injury may result. The user must be cautious at all times and handle the weapon in a manner that one would handle a conventional firearm to insure that inadvertant injury or damage does not occur.

In the event that, for some particular purpose, enhanced destructive power or range is desired for the missiles, it is contemplated that the weight of the missiles may be increased to produce these results. In such case metal rings would be crimped in encircling relationship around the tube of a missile, such as rings 110, FIG. 8, to increase the missile weight.

I claim:

1. A gun for projecting resilient loop missiles, said gun comprising:

a body including a handle and an elongated frame for holding a missile in a stretched condition, said body having a cavity extending therethrough;

a member slidably positioned in the cavity including trigger means projecting from the cavity forwardly of the handle, and plunger means movable with the member to a missile engaging position for dislodging the latter; and means on the body to confine the member to a rectilinear, fore and aft path of travel in the cavity, said path being inclined upwardly as the rear of the gun is approached, whereby said plunger may impart a generally upwardly and rearwardly lifting force on the missile to enhance the projection thereof, said body being configured to present a pair of grooves at the rear of the gun to facilitate the positioning of missiles on the gun in stretched condition, one of the grooves being spaced upwardly and forwardly of the other groove and adjacent the path of travel of the plunger means for dislodgement thereby, said other groove being on the outer surface of the body at the rear thereof and spaced downwardly of the body and below-said one of the grooves in disposition clear of the plunger mean's 's path of travel, whereby a stored stretched missile positioned on the gun in said other groove will not be dislodged by said plunger means when the latter is moved to a missile dislodging position, and a stretched missile may be readily positioned manually in said one groove so as to be in position for release by said plunger means.

2. The invention of claim 1, wherein the body has a pair of parallel, spaced apart cavity defining walls, and wherein said member is configured to present a pair of spaced apart shoulders, each shoulder being disposed to slidingly engage a corresponding one of said walls, the shoulders and walls cooperating to confine the movement of said member to said rectilinear path of travel.

3. The invention of claim 1, wherein said body is tapered proximal the region of said grooves to a reduced transverse cross-sectional dimension as the top of the body is approached, whereby to facilitate movement of a stretched missile from a standby position extending through said other groove, in an upwardly and forwardly direction to a ready position extending through said one groove.

4. The invention of claim 1, said handle being elongate, and wherein the upper end of said handle joins said frame intermediate the ends of the latter with the frame projecting rearwardly a substantial distance from said upper handle end, whereby said frame may be of sufficient length for holding the missile in properly stretched condition while minimizing the forward projection of the frame from the handle.

5. The invention of claim 1, wherein is included friction reducing means on the member and engageable with the walls of said cavity to facilitate smooth and easy movement of the member.

6. The invention of claim 5, wherein said friction reducing means includes a coating of tetrafluoroethylene material.

7. The invention of claim 1, wherein said frame is configured to present a notch at the forward end of the gun to releasably retain said missile on the frame.

8. The invention of claim 1, wherein is included means for augmenting the weight of the frame and the handle respectively, whereby to enhance the handling and balance of the gun.

9. The invention of claim 8, wherein said augmenting means includes at least one metal slug embedded in the frame and at least one metal slug embedded in the handle proximal the base of the latter.

10. A gun for projecting resilient loop missiles, said gun comprising:

a body including a handle and an elongated frame for holding a missile in a stretched condition, said body having a cavity extending therethrough;

a member slidably positioned in the cavity includes trigger means projecting from the cavity forwardly of the handle, and plunger means movable with the member to a missile engaging position for dislodging the latter, said plunger means including a surface inclined upwardly as the front of the gun is approached and biasing means in the cavity for biasing the member forwardly along a plurality of substantially parallel guide members that form openings for receiving postions of said slidable member;

a rectilinear, fore and aft path of travel in the cavity, stop means on the body and engageable by the member to limit the extent of movement of the member along said rectilinear path of travel, said path being inclined upwardly and rearwardly as the rear of the gun is approached, whereby the surface of the plunger means may impart a generally upwardly and rearwardly lifting force on a missile to enhance the projection thereof, said body being configured to present an opening communicating with the cavity; and a projection on the plunger means disposed to extend through the opening as said member is moved along said path of travel, the projection being of sufficient size to be visible throughout the range of movement of the member, thereby providing a sight for said gun.

11. The invention of claim 10, wherein said surface is arcuate.

12. The invention of claim 10, wherein is included stop means on the body and engageable by the member to limit the extent of movement of the member along said rectilinear path of travel, and wherein is included resilient means operably coupled to the body and to the member for yieldably biasing the latter toward the forward end of said path of travel.

13. The invention of claim 12, wherein said resilient means includes an elastic band, one end of said band being secured to the body and the other end of said band being secured to the member whereby rearward movement of the member stretches the elastic material of said band.

14. The invention of claim 12, wherein said stop means includes a resilient ring disposed to cushion the impact of the member at one end of its path of travel.

* * * * *